US006075333A

United States Patent [19]

Huddle

[11] Patent Number: 6,075,333

[45] Date of Patent: Jun. 13, 2000

[54] KIT FOR RETROFITTING MANUALLY OPERATED ELECTRIC GARAGE DOOR TO OPERATE AUTOMATICALLY

[76] Inventor: Stephen Huddle, 2212 39th St., Lubbock, Tex. 79412

[21] Appl. No.: 08/989,277

[22] Filed: Dec. 12, 1997

[51] Int. Cl.[7] ..... E05F 15/16

[52] U.S. Cl. ..... 318/468; 318/266; 318/469; 49/26; 49/30

[58] Field of Search ..... 318/264, 265, 318/266, 267, 286, 445, 466, 468, 469; 49/26, 29, 30

[56] References Cited

U.S. PATENT DOCUMENTS

| | | | |
|---|---|---|---|
| 3,783,556 | 1/1974 | Cook | 49/25 |
| 4,843,639 | 6/1989 | Beals | 359/147 |
| 5,285,136 | 2/1994 | Duhame | 318/266 |

*Primary Examiner*—Bentsu Ro
*Attorney, Agent, or Firm*—Tod R. Nissle, P.C.

[57] ABSTRACT

A method and apparatus for retrofitting a manually operated commercial garage door opener to function automatically.

6 Claims, 5 Drawing Sheets

Figure 1:
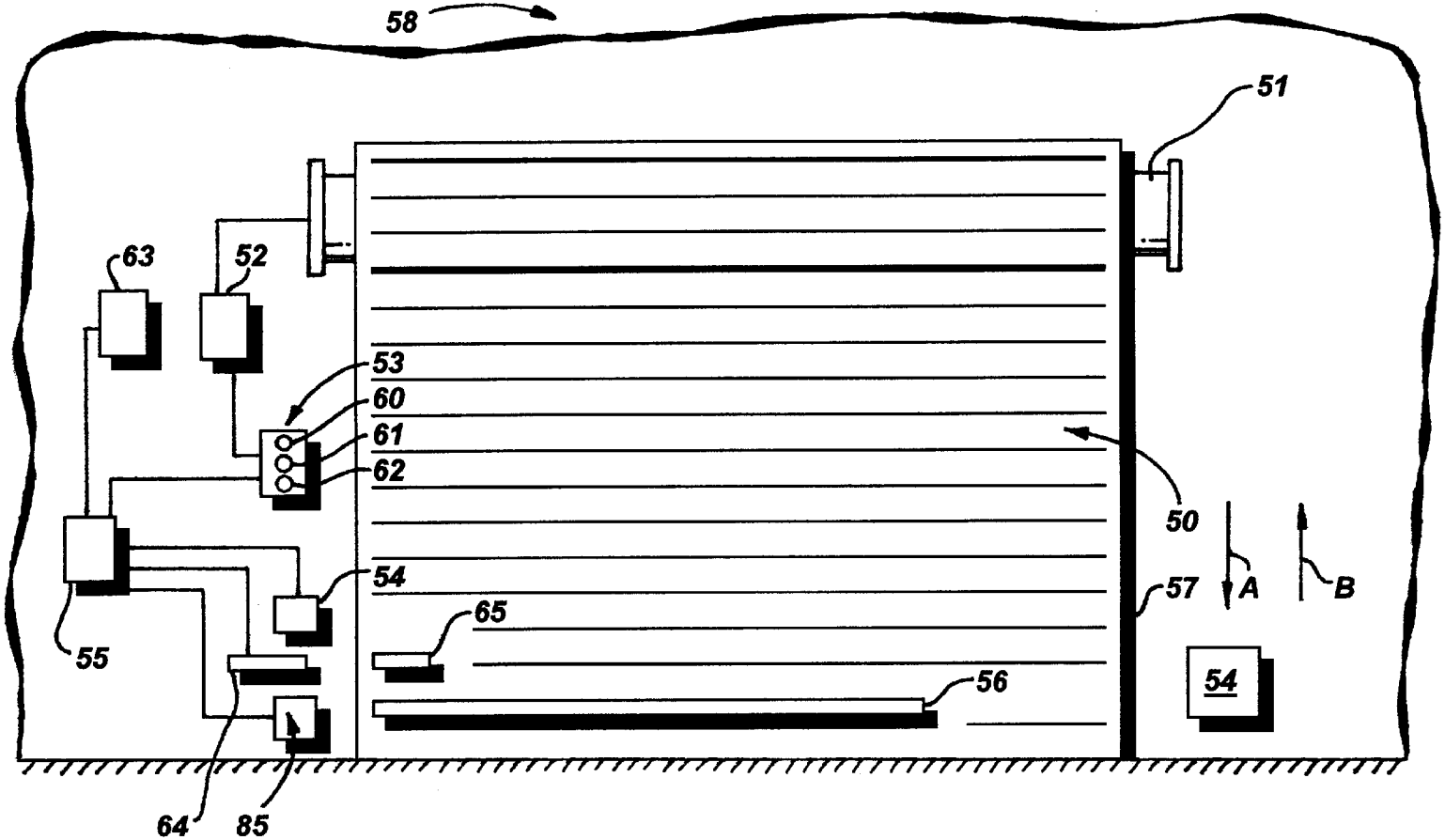

KIT FOR RETROFITTING MANUALLY OPERATED ELECTRIC GARAGE DOOR TO OPERATE AUTOMATICALLY

This invention relates to garage doors.

More particularly, the invention relates to a method and apparatus for retrofitting a manually operated electric garage door so the garage door automatically opens and closes.

Many systems are known which utilize a motor to open and close a garage door. For example, U.S. Pat. No. 4,939,434 to Elson describes a garage door closure system in which the door automatically closes after the door has inadvertently been left open. Elson's garage door closure system typically causes a garage door to close after it has been open for a preselected period of time, typically in the range of 50 to 190 seconds. The Elson closure system is utilized on a residential garage door and does not include the manual open, close, stop buttons associated with commercial garage door systems. In addition, the owner of a commercial system ordinarily does not forget to close a garage door. Further, while waiting 50 to 190 seconds for a door to automatically close appears desirable, such a procedure is not believed appropriate in a commercial setting because it is more cost effective to close the garage door to maintain interior air temperatures and to separate work areas from customers.

U.S. Pat. No. 3,783,556 to Cook describes a system for automatically opening and closing a garage door. Cook's system includes bell hose and a photocell. The bell hose activates a treadle switch when a vehicle's tires roll over the hose. The photocell utilizes a light beam and sensor to detect the presence of an object in the doorway of the garage. In Cook's system, the garage door is automatically opened when a vehicle's tires roll over the bell hose. After the garage door is fully opened, it closes automatically once the photocell light beam is interrupted and re-established, either while the door is opening or after the door has completely opened. See Col. 8, lines 54 to 56, of the Cook patent.

One disadvantage of the system described in the Cook patent is that its cost is believed to be prohibitive, in the range of approximately $3,000.00 to $4,000.00. In addition, while waiting for the photocell beam to be interrupted prior to closing a garage door appears desirable, such a procedure is not believed appropriate in a commercial setting because it is more cost effective to close the garage door to maintain interior air temperatures and to separate work areas from customers, regardless of whether or not the photocell beam has been interrupted. This is also a complete system including motor tracks, door and controller, and, accordingly is not a retrofit.

Accordingly, it would be highly desirable to provide an improved method and apparatus which would provide a relatively inexpensive method of providing an automatic commercial garage door closure system, which would minimize the length of time a garage door was open, and which would enable the ready manual operation of the garage door closure system.

Therefore, it is a principal object of the invention to provide an improved automatic commercial garage door closure method and apparatus.

A further object of the invention is to provide an improved commercial garage door method and apparatus which provides both manual and automatic operation at a nominal cost.

Another object of the invention to provide an improved commercial garage door method and apparatus which facilitate maintenance of the interior ambient temperature of a garage and reduces the amount of time that the work areas of a garage are accessible to customers.

Figure 2A:
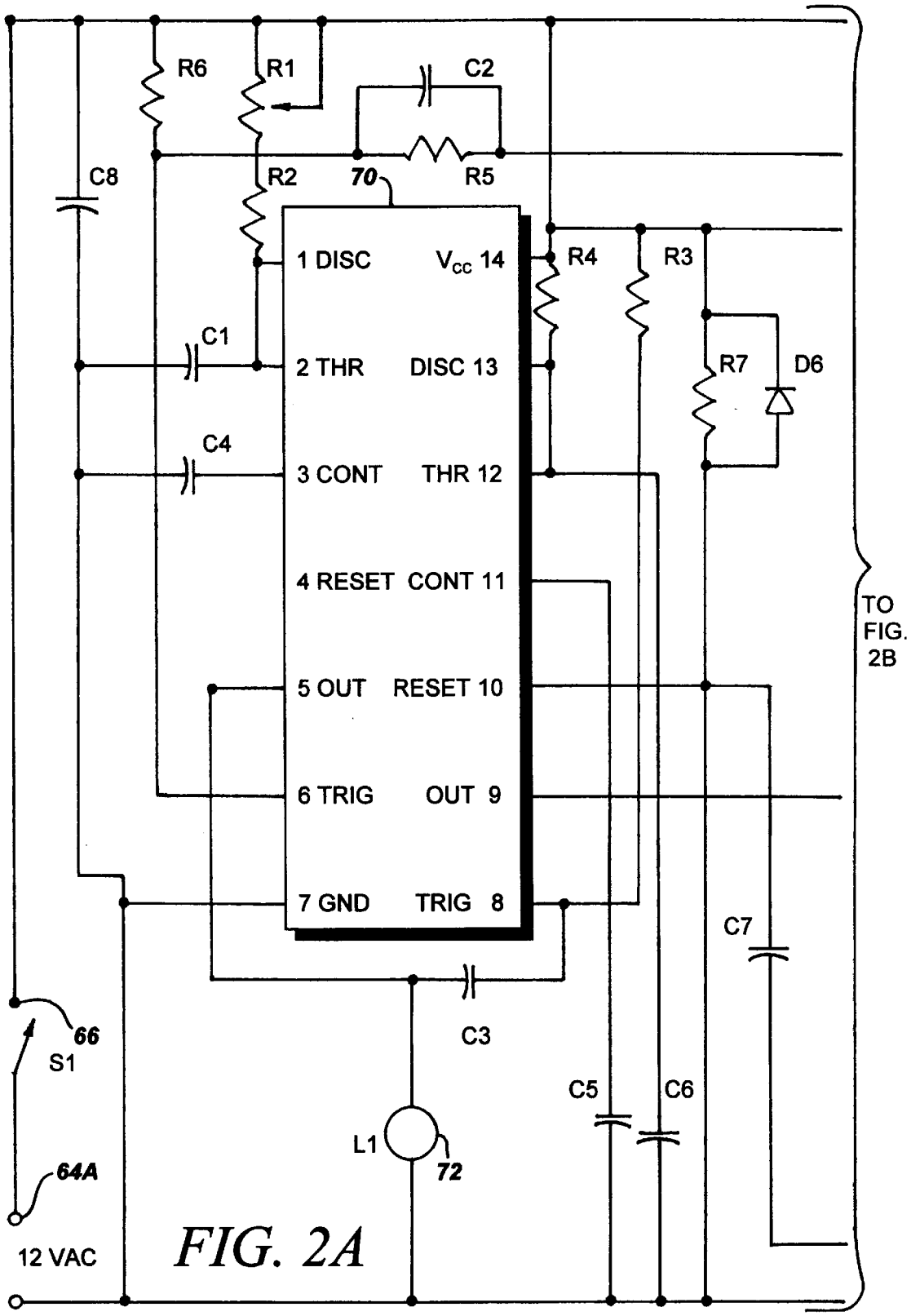
Figure 2B:
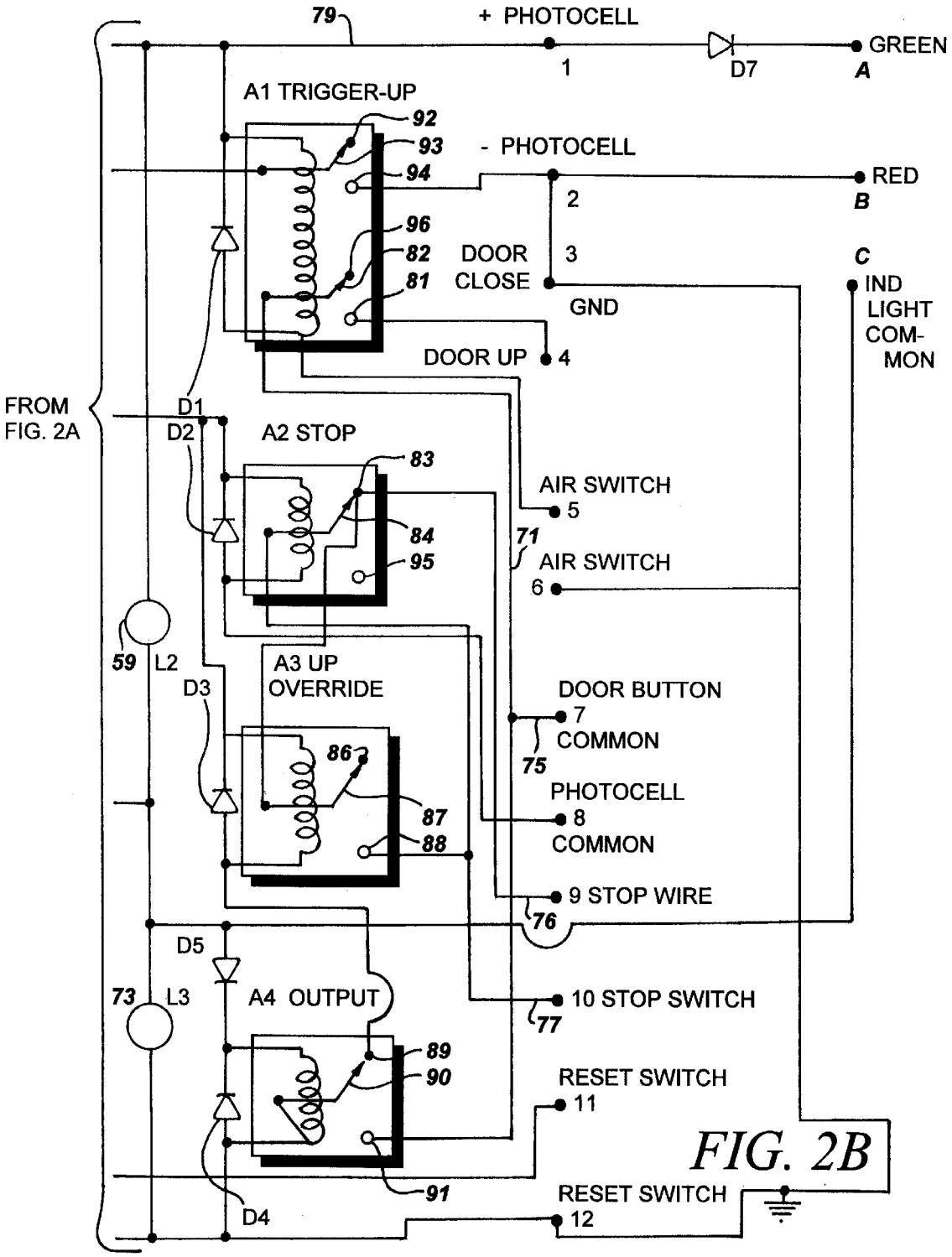
Figure 3A:
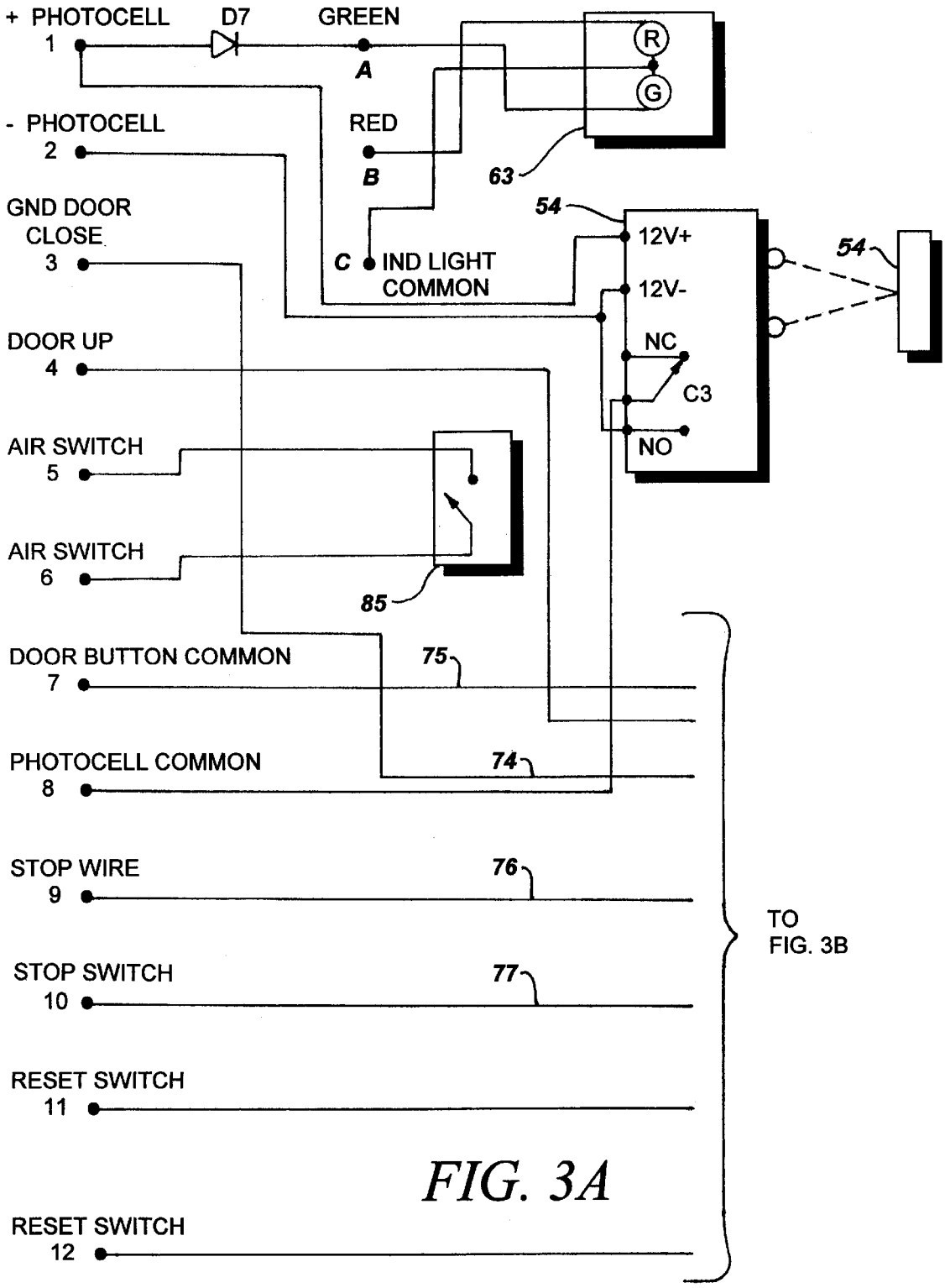
Figure 3B:
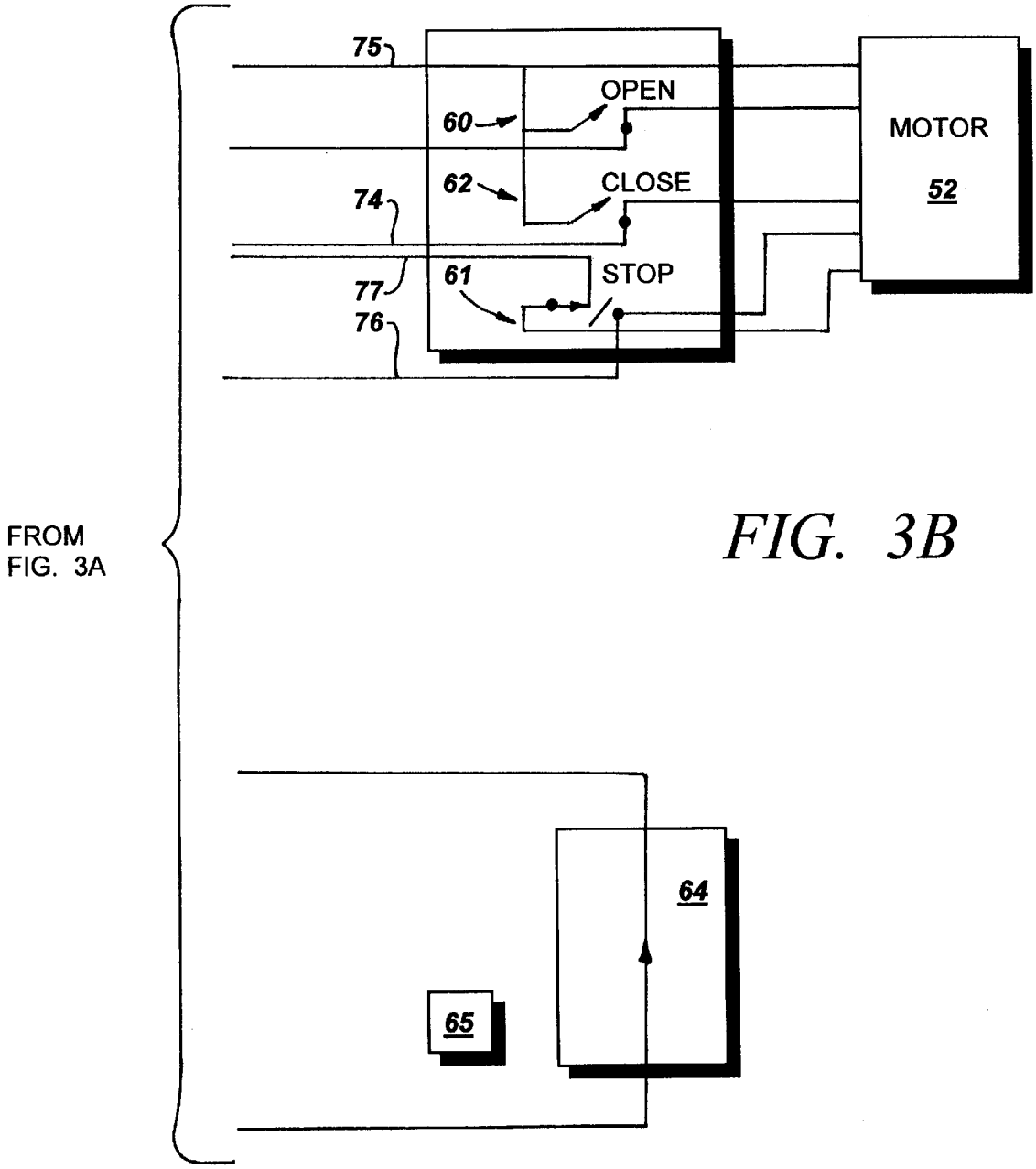

These and other, further and more specific objects and advantages of the invention will be apparent to those skilled in the art from the following detailed description thereof, taken in conjunction with the drawings, in which:

FIG. 1 is a front elevation view illustrating a garage door closure system constructed in accordance with the principles of the invention; and, FIGS. 2 and 3 comprise a wiring diagram of the presently preferred embodiment of the invention.

Briefly, in accordance with my invention, I provide a retrofit kit for a garage door system. The garage door system includes a doorway; a garage door to open and close the doorway; a motor for moving the garage door between a closed position and an open position; a first manually activated switch for activating the motor to open the garage door; a second manually activated switch for activating the motor to close the garage door; and, a third manually activated switch to stop the motor and to stop movement of the garage door. The retrofit kit automatically opens and closes the garage door and permits manual operation of the garage door. The kit includes a first detection sensor to detect the presence of an object in the doorway; a second detection sensor to detect the presence of a vehicle moving toward the doorway; a control system connected to the first and second detection sensors; and, a connection system for connecting the control system to the garage door system such that the garage door automatically opens when the second detection sensor detects a vehicle moving toward the doorway, such that the garage door automatically closes after a preselected period of time unless the first detection sensor detects an object in the doorway, and such that the control system can be deactivated to permit the first, second and third manually activated switches to open, close, and stop the garage door.

In another embodiment of the invention, I provide a retrofit kit for a garage door system. The garage door system includes a doorway; a garage door to open and close the doorway; a motor for moving the garage door between a closed position and an open position; a first manually activated switch for activating the motor to open the garage door; a second manually activated switch for activating the motor to close the garage door; and, a third manually activated switch to stop the motor and to stop movement of the garage door. The retrofit kit automatically opens and closes the garage door. The kit includes a first detection sensor to detect the presence of an object in the doorway; a second detection sensor to detect the presence of a vehicle moving toward the doorway; a control system connected to the first and second detection sensors; and, a connection system for connecting the control system to the garage door system such that the garage door automatically opens when the second detection sensor detects a vehicle moving toward the doorway, and, such that the garage door automatically closes after a preselected period of time unless the first detection sensor detects an object in the doorway.

In a further embodiment of the invention, I provide an improved method for retrofitting a garage door system. The garage door system includes a doorway; a garage door to open and close the doorway; a motor for moving the garage door between a closed position and an open position; a first manually activated switch for activating the motor to open the garage door; a second manually activated switch for activating the motor to close the garage door; and, a third manually activated switch to stop the motor and to stop movement of the garage door. The improved method includes the step of providing a kit. The kit includes a first detection sensor to detect the presence of an object in the doorway; a second detection sensor to detect the presence of a vehicle moving toward the doorway; a control system connected to the first and second detection sensors; and, a connection system for connecting the control system to the garage door system such that the garage door automatically opens when the second detection sensor detects a vehicle moving toward the doorway, and such that the garage door automatically closes after a preselected period of time unless said first detection sensor detects an object in the doorway. The method also includes the step of interconnecting the control system and the garage door system with the connection system.

Turning now to the drawings which depict the presently preferred embodiments of the invention for the purpose of describing the operation thereof and not by way of limitation of the scope of the invention, and in which like reference characters refer to corresponding elements throughout the several views, FIG. 1 illustrates a commercial garage door opening and closure system constructed in accordance with the invention and including a rectangular doorway 57 leading into a work bay or other area inside garage 58. Reversible motor 52 turns cylinder 51 to wind (i.e., open) and unwind (i.e., close) garage door 50. Winding door 50 onto cylinder 51 opens doorway 57. Unwinding door 50 from cylinder 51 closes doorway 57. Manually operated switching unit 53 includes three buttons or switches. Depressing green button 60 causes door 50 to open. Depressing green button 62 causes door 50 to close. Depressing red button 61 causes door 50 to stop. If door 50 is moving in one direction, red button 61 must be depressed to stop door 50 before door 50 can be moved in the opposite direction. For example, if door 50 is being closed and is being unwound in the direction of arrow A, button 61 must be depressed to stop door 50 before button 60 can be depressed to wind door 50 on cylinder 51 such that door 50 moves in the direction of arrow B.

The retrofit kit of the invention is used in combination with pre-existing switches 60 to 62, reversible motor 52, cylinder 51, and door 50. As would be appreciated by those of skill in the art, various types of commercial garage doors and mechanisms for opening and closing such doors exist, and the invention can be utilized in combination with any such pre-existing commercial doors.

The retrofit kit of the invention includes photocell system 54 (presently preferably utilizing an infrared photocell, Radio Shack Part No. 49-532) for detecting the presence of an object in doorway 57, includes bell hose system 85 for detecting a vehicle moving toward doorway 57 when the wheels of the vehicle run over bell hose 56, and includes control unit 55. Other sensors can be utilized in place of or in conjunction with photocell system 54 to detect the presence of an object in doorway 57. For example ultrasonic, capacitive, inductive, radar and other systems can be utilized. Similarly, any other desired sensor can be utilized in place of or in conjunction with bell hose system 85 in order to detect a vehicle moving toward doorway 57.

As will be described below, five wires interconnect controller 55 with switches 60 to 62. Three of these wires are connected in parallel with switches 60 and 62. The remaining two wires are connected in series with switch 62. Consequently, when power to controller 55 is disconnected, switches 60 to 62 can be manually operated.

FIGS. 2 and 3 illustrate the controller 55 in conjunction with motor 52, switches 60 to 62, photocell 54, and bell hose system 85. The controller 55 includes dual timer chip 70, trigger up relay A1 (Radio Shack Part No. 275-249), stop relay A2, up override relay A3, and output relay A4 (Phillips Part No. RLY6122, as are relays A2 and A3), 100 mf capacitors (25 WVDC) C1 and C6 and C8, 0.047 mf capacitor (25 WVDC) capacitor C2, 0.1 mf capacitors (25 WVDC) C3 and C4 and C5, 1.0 mf capacitor (25 WVDC) C7, 1N194 diodes D1 to D11, remote indicator assembly 63 with a red indicator light and a green indicator light, Milton (Model 825) Air Switch 85 (bell hose system), a one meg ten turn potentiometer R1, 22 k resistors (¼ watt) R2 and R3 and R6, ten meg resistor (¼ watt) R4, one meg resistors (¼ watt) R5 and R7, on—off switch 66, magnetic reset switch (Radio Shack Part No. 49-532) 64 with magnet 65 attached to door 50, and twelve volt DC battery 64A. A 120 VAC to 12 VDC transformer can also be utilized to provide DC current for controller 55. The wiring interconnecting the foregoing components to switches 60 to 62, photocell 54, remote indicator 63, and bell hose system 85 is illustrated in FIGS. 2 and 3.

Dual timer chip 70 is set as a cascade timer with a front side adjustable delay of three to about sixty-nine seconds and a fixed approximate 660 second output on the back side. The three to sixty-nine second delay on chip 70 is adjusted utilizing potentiometer R1. The delay determines the amount of time after the door begins to open and the vehicle rolls over hose 56 a second time before a down signal is delivered.

During the following description of the operation of the automatic door opening and closing system of the invention, it is assumed that the timer chip 70 is set such that the door pauses only three seconds after it is fully open and then begins to close.

In operation, when a vehicle's front wheels roll over hose 56, the switch in the bell hose system 85 closes, momentarily grounding the trigger-up relay A1 and causing the normally closed switch 82 of the trigger-up relay A1 to move from contact 96 to contact 81 to close and link the door—up line 78 and door button common line 71. This electrically activates motor 52 and causes door 50 to open in the direction of arrow A. The trigger goes to ground when switch 93 in trigger-up relay A1 moves from contact 92 to contact 94, but when door 50 initially begins to open the reset switch magnet 65 is still adjacent reset switch 64 in the position illustrated in FIG. 1. This prevents the front side of the timer chip 70 from starting. After the door 50 rises a short distance in the direction of arrow B, magnet 65 is displaced from adjacent switch 64 and switch 64 opens. After door 50 opens a sufficient amount, the vehicle passes through doorway 57 and the rear wheels of the vehicle pass over hose 56, again closing the switch in system 85 to momentarily ground the trigger-up relay A1 and cause the upper set of contacts in relay A1 to close across the trigger pin 93 to system ground pin 94. This also starts timer 70 and illuminates amber indicator light 72. The timer starts and the amber indicator light illuminates only after all three of the following conditions are met: the door begins to rise, the switch magnet 65 is displaced, and a second pulse is delivered from the hose 56. The illumination of the amber indicator light is used as a visual indication of the adjustable running time for the front half of the timer before the back half of the time supplies the down signal so as to allow the door to pause approximately three second after reaching the fully open position before starting the down cycle. The three second pause prevents instantaneous reversal of the door and possible damage therefrom.

Indicator 72 remains illuminated while the door 50 rises and while it remains open for three seconds before automatically beginning to close. After the door 50 pauses for three seconds in the open position, the back side of the timer 70 goes on, causing the green 59 and amber 72 indicator lights (FIG. 2) to turn off and the red indicator light 73 to illuminate. When the back side of the timer 70 goes on, output relay A4 cycles to the normally open position, connecting the door close 74 line to the door common line 75 to cause motor 52 to close door 50 by moving door 50 in the direction of arrow B. Once door 50 reaches the fully closed position illustrated in FIG. 1, magnet 65 is once again adjacent switch 64 and, accordingly, closes switch 64 resetting timer 70 for the next opening of door 50. Red indicator light 73 goes off and green 59 indicator light goes on indicating the door is ready for a new cycle.

The A2 and A3 relays form a series parallel circuit wired in series between the stop wire 76 and the wire 77 leading to the stop switch 61. When door 50 is closed or is being opened, the A4 relay provides a path to ground for the A3 up override relay and provides a closed circuit from line 77 connected to the stop switch 61 through the normally open contact 88 which is now connected to the swing contact or switch 87 (switch 87 having moved from contact 86 to contact 88), bypassing the A2 relay to line 76 connected to the stop switch 61. When a vehicle breaks the light beam from photocell 54, relay A2 is activated. If the door 50 is opening in the direction of arrow B, actuating relay A2 does not stop the movement of door 50 in the direction of arrow B. If, however, door 50 is closing in the direction of arrow A, the A4 output relay is energized (switch 90 moves from contact 89 to contact 91), the A3 relay loses its path to ground and, since lines 76 and 77 from the stop switch 61 are closed only through the A2 relay, when a vehicle breaks the light beam from photocell 54, the A2 relay is activated (switch 84 moves from contact 83 to contact 95), opening the circuit between lines 76 and 77 and causing motor 52 and door 50 to stop. When the vehicle moves out of doorway 57 and the light beam from photocell 54 is re-established, the photocell 54 and relay A2 reset to the normally closed position with switch 84 contacting contact 83 (this normally closed position is illustrated in the upper right hand corner of relay A2 in FIG. 2), and, the relay coil in A2 is de-energized because the photocell light beam is re-established and the photocell common terminal has no path to ground for the A2 coil. Further, the circuit between lines 76 and 77 at stop switch 61 is closed, the A4 relay is still activated (i.e., the swing contact or switch 90 contacts contact 91), the circuit between lines 74 (door close) and 75 (door button common) is still closed, and door 50 resumes its movement in the direction of arrow A.

Timer 70 presently preferably allows about an eleven minute long window for the door 50 to close, including any stoppages of the door in the event the beam from photocell 54 is broken by a vehicle entering doorway 57 or by some other object. When door 50 fully closes, switch 64 and timer 70 reset.

In the event the door is blocked (i.e., a vehicle interrupts and blocks the beam from photocell 54) for longer than the eleven minute window, the output cycle of timer 70 resets and, when the vehicle blocking the beam from photocell 54 pulls clears of doorway 57 and pulses bell hose system 85, door 50 rises and timer 70 starts. Timer 70 starts because the reset switch 64 is open. When the door is partially open, the timer starts immediately. When the preset "pause" time of three seconds (or some other preselected pause time) elapses, the door 50 begins to close in the manner earlier described.

Pins A-B-C (shown in the upper right hand corner of FIG. 2) are connected to the green, red, and indicator light common wires of the remote indicator 63. Box 63 on the exterior wall of garage 58 indicates the module function and door position. Line 79 connected to photocell 54 is isolated from pin A by diode D7 to prevent the controller 55 from being powered by an external power source through the remote indicator circuits. The remote indicator circuits are a set of circuits across timer chip terminals 14 (Vcc) and 9 (backside output) for the red indicator light 73 and across 9 (backside output) and 7 (timer chip ground) for the green indicator light 59 and across pin 5 (front side output) and pin 7 (ground) for the amber indicator light 72. All of these indicator lights 59, 73 are located on the face of controller 55. The remote indicator circuits are also common to pins B and C for the red remote indicator light in box 63 and pins A and C for the green remote indicator light in box 63. Box 63 is, as earlier noted, attached to the exterior wall of garage 58 near door 50. The indicator lights in box 63 permit identification of the door position and direction of travel when overhead visibility is restricted. When the green indicator light on box 63 is on, door 50 is closed and ready to receive the open signal, or, door 50 is going up. When the red indicator light on box 63 is on, the door 50 is coming down, or, if door 50 has been stopped by an obstruction before it has closed completely, then door 50 will resume its downward direction of travel when the obstruction is cleared from the door. When the amber light is on, the door has started up, aa second up pulse has been delivered by hose 56 through the trigger-up relay and the front side of the timer is running.

Rolling the tires of a vehicle over hose 56 does not cause door 50 to open unless the power is on to controller 55 and the green indicator light (indicating the door is down and ready to be opened) on box 53 is on. Rolling the tires of a vehicle over hose 56 while door 50 is moving down does not halt the downward travel of door 50. Door 50 must close completely before it can be opened.

The twelve wire color coded connector loom plugs onto the module pins in a manner similar to that in which a computer module or card plugs onto pins on the mother board of the computer. The color coding simplifies identification of connections necessary to install the retrofit system of the invention and also simplifies connection of the invention to existing wiring and terminals.

Five leads connect to the existing door control switches 60 to 62 (up—green wire, down—purple wire, stop—blue wire, stop wire—blue/white, and common—yellow wire). Three leads connect to the photocell 54 (twelve volts—red wire, ground—black wire, and light beam common—brown wire). A short ground loop from the photocell ground (black wire) to the normally open contacts in the photocell supplies a path to ground for the A2 relay. The photocell is a self contained unit with an internal relay. Both the photocell and the internal relay coil receive 12 volt dc power from the controller 55 via the loom connector. The internal relay has a common or swing contact or switch C3, a contact NO for when the switch is normally open, and a contact NC for when the switch C3 is normally closed. Whether switch C3 contacts contact NO or NC is determined when power is established across the door opening and there is or is not an obstruction in the doorway 57. Normally closed is defined as power on and light beam unobstructed. If either condition is not met, C3 defaults to the normally open position.

When the light beam is broken (when the doorway for door 50 is obstructed), switch C3 moves into contact with the NO contact which then completes a circuit from the coil of the A2 stop relay through the photocell relay common to the NO contact through the short jumper from the NO contact to the 12V negative. The 12V negative is the system ground. If the door 50 is rising, stop relay A2 is bypassed by the up-override relay A3. If the door 50 is closing, the output relay A4 energizes and breaks the path to ground for the up-override relay A3 and photocell interruption will then actuate stop relay A2 and door 50 will stop. When the obstruction in door 50 is removed and the photocell resets, and stop relay A2 returns to the NC position (switch 84 contacts contact 83). The NC position for relay A2 is 84 to 83 (at rest). No path to ground exists for the A2 coil because the door is clear (not blocked), because the light beam is unobstructed, and because photocell switch C3 is at the NC position; therefore, no path to ground exists. Since output relay A4 is still energized (unless a time period of approximately eleven minutes has elapsed), a down signal is still present and the door will continue to close. The door 50 will, however, be stopped again if another obstruction in the doorway 57 interrupts the photocell beam. Photocell 54 is illustrated in FIG. 3.

Two leads (orange wires) connect to the magnetic reset switch 64 which is normally closed when the door 50 is closed. A pair of leads (gray wires) connect to the bell hose system 85.

A right angle or other bracket or mounting apparatus is provided to mount switch 64 (on garage 58) and magnet 65 (on door 50).

Brackets or other mounting apparatus are provided to mount photocell 54, including its reflector.

The controller 55 is preferably fabricated as a module designed to mount to the wall of garage 58, preferably near existing switches 60 to 62.

The hardware for mounting the controller and other components of the invention comprise part of the invention.

The maximum length of any wire lead interconnecting the controller 55 with switches 60 to 62, 64, photocell 54, or bell hose system 55 is ten feet. The power and common wires to the photocell 54 and reset switch 64 can normally be up to ten feet long. The wires from the bell hose system 85 to module 55 preferably are no longer than about one foot. The wires from module 55 to switches 60 to 62 preferably are no longer than six feet. The wires from module 55 to remote indicator 63 are preferably no longer than six feet.

The retrofit kit of the invention operates a properly functioning commercial door opening system. This means that the commercial door opening system must include a stop button 61 which will stop door 50 immediately when door 50 is closing. Controller 55 remotely performs the functions of the control switches 60 to 62 and will not make an improperly operating door function properly. When switch 66 is opened to turn off controller 55, bell hose 55 and photocell 54 do not function and switches 60 to 62 are manually operated to open and close door 50.

Having described my invention in such terms as to enable those skilled in the art to make and practice the invention, I claim:

1. A retrofit kit to automatically operate an existing manually operated garage door system, the garage door system including a doorway, a garage door to open and close the doorway, a motor for moving the garage door between a closed position and an open position, and a first manually activated switch means for activating the motor to open the garage door, a second manually activated switch means for activating the motor to close the garage door, and a third manually activated switch means to stop the motor and to stop movement of the garage door, said kit including (a) first detection means to detect the presence of an object in the doorway;

(b) second detection means to detect the presence of a vehicle moving toward the doorway;

(c) control means connected to said first and second detection means;

(d) connection means for connecting said control means to said garage door system such that (i) the garage door automatically opens when said second detection means detects a vehicle moving toward the doorway, (ii) the garage door automatically closes after a preselected period of time unless said first detection means detects an object in the doorway, and (iii) said control means can be deactivated to permit said first, second and third manually activated switch means to open, close, and stop the garage door.

2. The retrofit kit of claim 1 wherein said connection means includes relay contacts connected in parallel with said first switch means of said existing garage door system.

3. The retrofit kit of claim 2 wherein said connection means includes relay contacts connected in parallel with said second switch means of said existing garage door system.

4. A method for retrofitting an existing manually operated garage door system, said existing garage door system including a doorway, a garage door to open and close the doorway, a motor for moving the garage door between a closed position and an open position, a first manually activated switch means for activating the motor to open the garage door, a second manually activated switch means for activating the motor to close the garage door, and a third manually activated switch means to stop the motor and to stop movement of the garage door, said method including the steps of (a) providing a kit including (i) first detection means to detect the presence of an object in the doorway, (ii) second detection means to detect the presence of a vehicle moving toward the doorway, (iii) control means connected to said first and second detection means, (iv) connection means for connecting said control means to said garage door system such that the garage door automatically opens when said second detection means detects a vehicle moving toward the doorway, and the garage door automatically closes after a preselected period of time unless said first detection means detects an object in the doorway; and, (b) interconnecting said control means and said garage door system with said connection means.

5. The method of claim 4 wherein in step (a)(iv) said connection means includes relay contacts for connection in parallel with said first switch means and wherein in step (b) said relay contacts are connected in parallel with said first switch means.

6. The method of claim 5 wherein in step (a)(iv) said connection means includes a second set of relay contacts for connection in parallel with said second switch means and wherein in step (b) said second set of relay contacts is connected in parallel with said second switch means.

* * * * *